US006591718B1

(12) United States Patent
Chang

(10) Patent No.: US 6,591,718 B1
(45) Date of Patent: Jul. 15, 2003

(54) RATCHET WRENCH

(76) Inventor: Chih-Min Chang, No. 10, Chin Tun Lane, Chin Tun Village, Hua Tan Hsian, Chang Hua Hsien (TW)

( * ) Notice: Subject to any disclaimer, the term of this patent is extended or adjusted under 35 U.S.C. 154(b) by 0 days.

(21) Appl. No.: 10/163,411

(22) Filed: Jun. 7, 2002

(30) Foreign Application Priority Data

Dec. 26, 2001 (TW) ..... 90222921 U

(51) Int. Cl.[7] ..... B25B 13/46
(52) U.S. Cl. ..... 81/60
(58) Field of Search ..... 81/60–63.2

(56) References Cited

U.S. PATENT DOCUMENTS 2,696,748 A * 12/1954 Relken ..... 81/61
5,388,479 A * 2/1995 Sroka ..... 81/63.1
5,425,291 A * 6/1995 Chang ..... 81/60
6,220,123 B1 * 4/2001 Chen ..... 81/63.2

* cited by examiner

*Primary Examiner*—D. S. Meislin
(74) *Attorney, Agent, or Firm*—Browdy and Neimark, P.L.L.C.

(57) ABSTRACT

A ratchet wrench comprises a wrench handle having a receiving portion at an end thereof, in which has a chamber at a side thereof and a slot in the chamber. A pawl is installed in the chamber having a teeth portion at a side thereof. A spring is installed in the chamber having an end thereof rested against the pawl and the other end thereof rested in the slot in the chamber. A driving member is rotatably received in the receiving portion and has an annular teeth portion at outer surface thereof to mesh with the teeth portion of the pawl and two engaging portions at opposite sides of the teeth portion respectively, and two covering members, each of which has a tube, an opening at central of the tube and an annular flange at an end of the tube. The covering members have the tubes inserted into the spaces between the receiving portion of the wrench handle and the engaging portions of the driving member respectively in an interference fit with the engaging portions.

7 Claims, 4 Drawing Sheets

RATCHET WRENCH

FIELD OF THE INVENTION

The present invention relates generally to a hand tool, and more particular to a ratchet wrench, which is easy to assemble components.

BACKGROUND OF THE INVENTION

A conventional ratchet wrench 90, please refer to FIG. 1, is mainly constructed of a wrench handle 91, a driving member 92, a pawl 93, a snap ring 94, a sealing cover 95 and a spring 96. The wrench handle 91 has a receiving portion 97 at an end thereof, in which provides an interior flange 98 and an annular slot 99. The sealing cover 95 is installed at an end of the receiving portion 97 and the snap ring 94 is installed in the annular slot 99 to lock the sealing cover 95 for the rest elements being fixedly installed in the receiving portion 97 of the wrench handle 91.

The sealing covers 95 are manufactured from a particular machine, so they have a stable quality. But, it needs a procedure to work the annular flange 98 and the annular slot 99 in the receiving portion 97 of the wrench handle 91 by a specific machine tool. The snap ring 94 needs an extending pliers to install it in the annular slot 99 and sometime the snap ring 94 will interfere with the driving member 92 to make it can not rotate freely. So, the conventional ratchet wenches 90 have a higher deficiency.

SUMMARY OF THE INVENTION

The primary objective of the invention is to provide a ratchet wrench, which has an easier way to assemble the components.

The second objective of the invention is to provide a ratchet wrench, which has a superior output power.

According to the objective of the invention, a ratchet wrench comprises a wrench handle having a receiving portion at an end thereof, in which provide a chamber at a side thereof and a slot in the chamber. A pawl is installed in the chamber having a teeth portion at a side thereof. A spring is installed in the chamber having an end thereof rested against the pawl and the other end thereof rested in the slot in the chamber. A driving member is rotatably received in the receiving portion and has an annular teeth portion at outer surface thereof to mesh with the teeth portion of the pawl and two engaging portions at opposite sides of the teeth portion respectively, and two covering members, each of which has a tube, an opening at central of the tube and an annular flange at an end of the tube. The covering members have the tubes thereof inserted into the spaces between the receiving portion of the wrench handle and the engaging portions of the driving member respectively in an interference fit with the engaging portions.

DETAIL DESCRIPTION OF THE INVENTION

Figure 1:
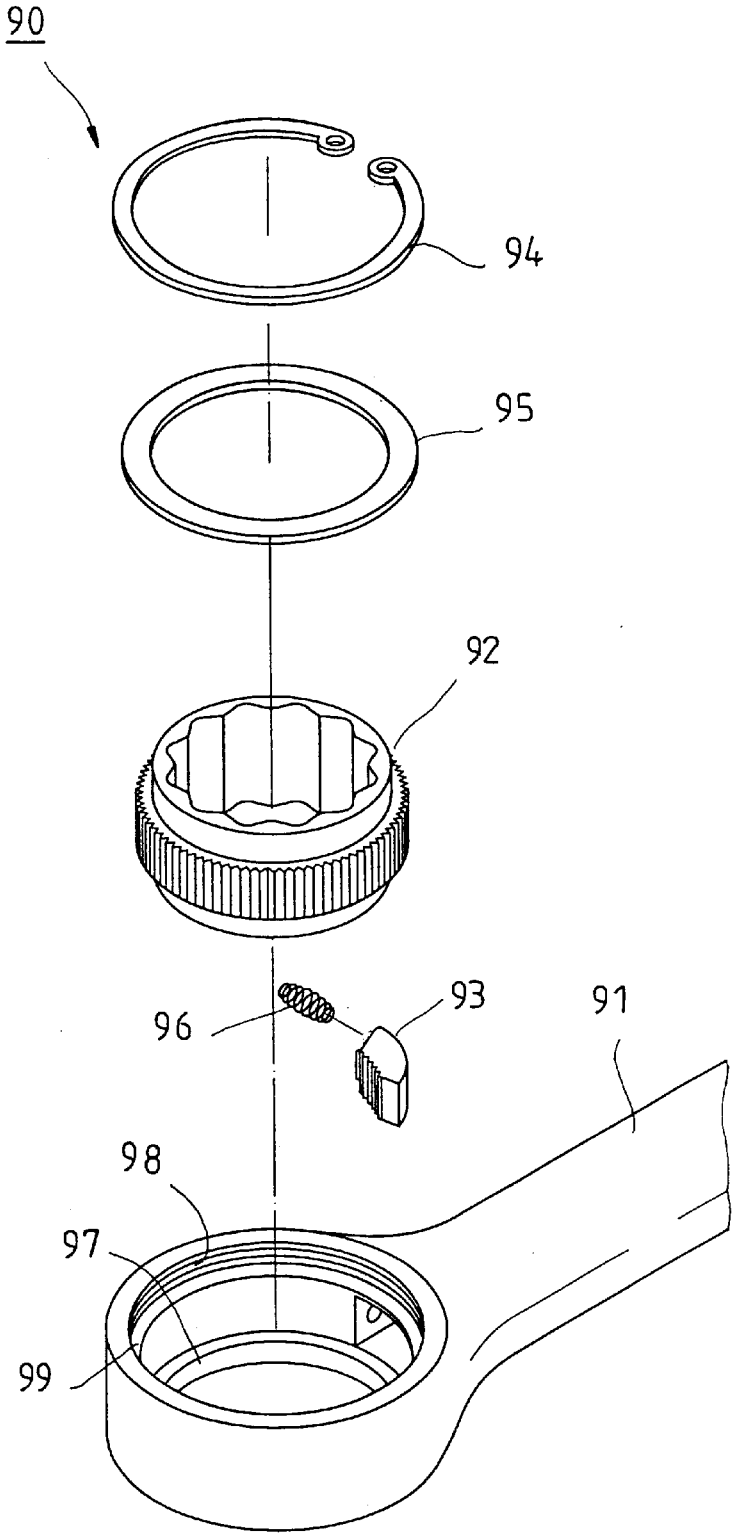
FIG. 1 is an exploded view of a conventional ratchet wench.
Figure 2:
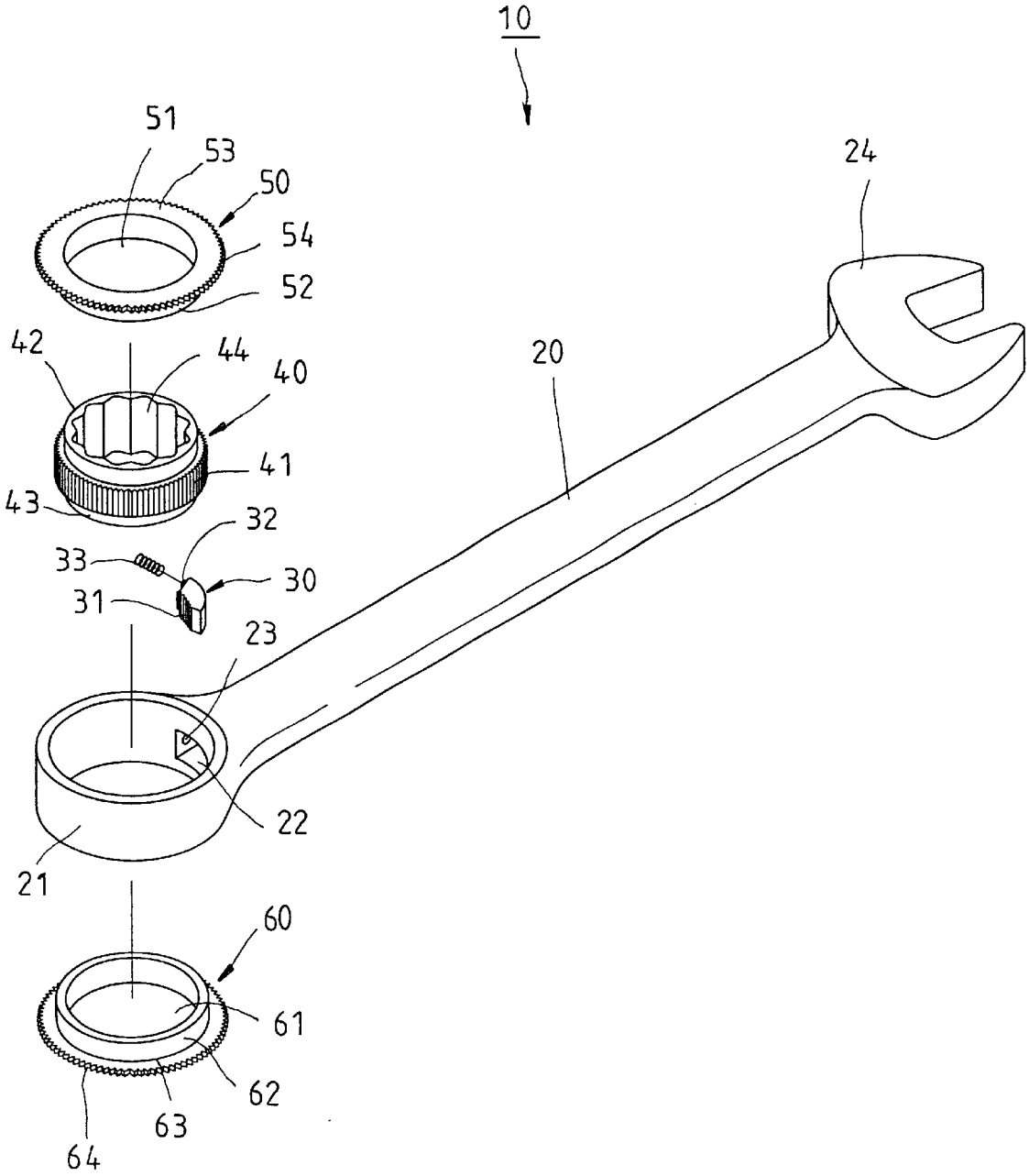
FIG. 2 is an exploded view of a first prefer embodiment of the present invention.
Figure 3:
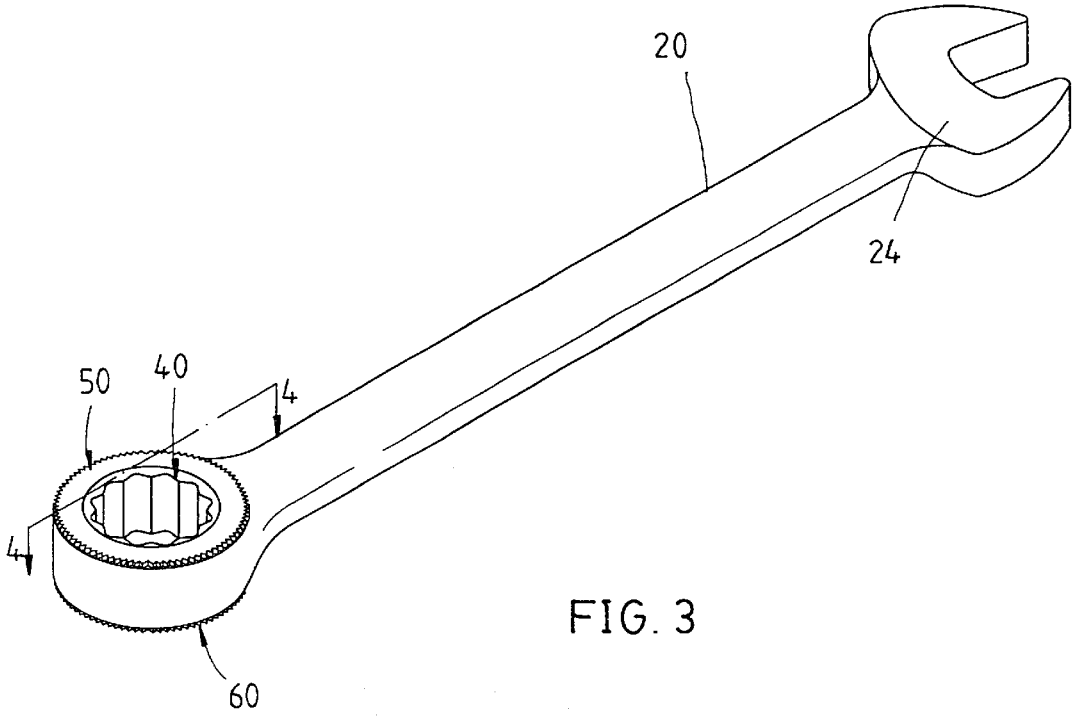
FIG. 3 is a perspective view of the prefer embodiment of the present invention in combination.

Please refer to FIG. 2 and FIG. 3, the first prefer embodiment of the present invention provides a ratchet wrench 10, which comprises a wrench handle 20, a pawl 30, a driving member 40 and two covering members 50 and 60, wherein The wrench handle 20 has a round receiving portion 21 at an end thereof and an open-end wrenching portion 24 at the other end thereof. The wrench handle 20 has a chamber 22 at a side of interior of the receiving portion and a slot 23 in the chamber 22.

The pawl 30 is installed in the chamber 22 of the wrench handle 20 having a teeth portion 31 at a side thereof and a lug 32. A spring 33 has an end thereof rested in the slot 23 in the chamber 22 and has the other end thereof sleeved onto the lug 32 of the pawl 30 to provide the pawl 30 a spring force making the pawl 30 rested against on the side wall of the chamber 22.

The driving member 40 is a tube-shaped element to be received in the receiving portion 21 of the wench handle 20. The driving member 40 has an annular teeth portion 41 at outer surface thereof to mesh with the teeth portion 31 of the pawl 30, two annular engaging portions 42 and 43 at opposite sides of the teeth portion 41 respectively and a polyhedral hole 44 at central to engage a nut or a bolt (not shown).

Each covering member 50 or 60 has a tube 52 or 62, an opening 51 or 61 at central of the tube 52 or 62 and an annular flange 53 or 63 at an end of the tube 52 or 62. The flange 53 or 63 has a knurled portion 54 or 64 at the edge thereof for user can be easy to hold the flange 53 or 63 to turn the covering member 50 or 60. The diameters of the openings .51 and 61 are about equal to or slightly smaller than the outer diameter of the engaging portions 42 and 43 of the driving member 40 and the outer diameters the tubes 52 and 62 are smaller than the inner diameter of the receiving portion 21. The outer diameters of the flanges 53 and 63 are about equal to the outer diameter of the receiving portion 21.

Figure 4:
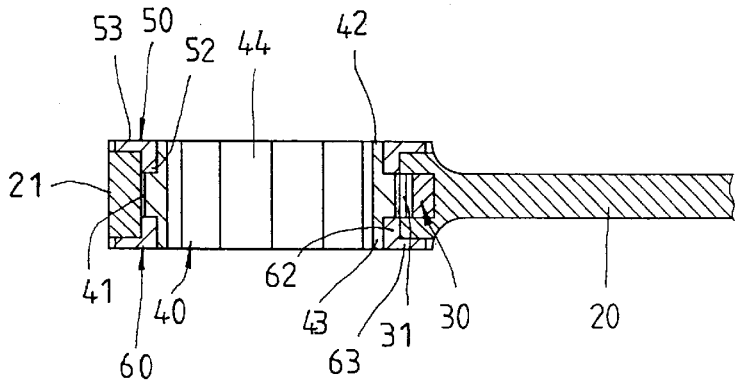
FIG. 4 is a sectional view taken along line 4—4 in FIG. 3.

To assemble the ratchet wrench 10 of the present invention, please refer to FIG. 4, the spring 33 is engaged to the lug 32 of the pawl 30 first, and then installs the pawl 30 and the spring 33 into the chamber 22 of the wrench handle 10. The driving member 40 is installed in the receiving portion 21 next to mesh with the pawl 30. The covering members 50 and 60 are installed to the wrench handle 20 at opposite ends of the receiving portion 21 respectively where the tubes 52 and 62 of the covering member 50 and 60 are inserted into the annular spaces between the receiving portion 21 of the wench handle 20 and the engaging portions 42 and 43 of the driving member 40 in an interfered fit with the engaging portions 42 and 43 of the driving member 40. Thus, the driving member 40 will not escape from the receiving portion 21 of the wrench handle 20 and can rotate freely.

It is obviously to see that the ratchet wrench 10 of the present invention has no need to provide an interior flange and an annular slot in the receiving portion 21 as the prior art did. The covering members 50 and 60 replace the interior flange, the annular slot and the sealing cover of the prior art. It reduces the cost and the time to manufacture the ratchet wrench 10 of the present invention and the strength of the structure of the ratchet wrench 10 of the present invention meets the loading of the normal ratchet wrench.

Figure 5:
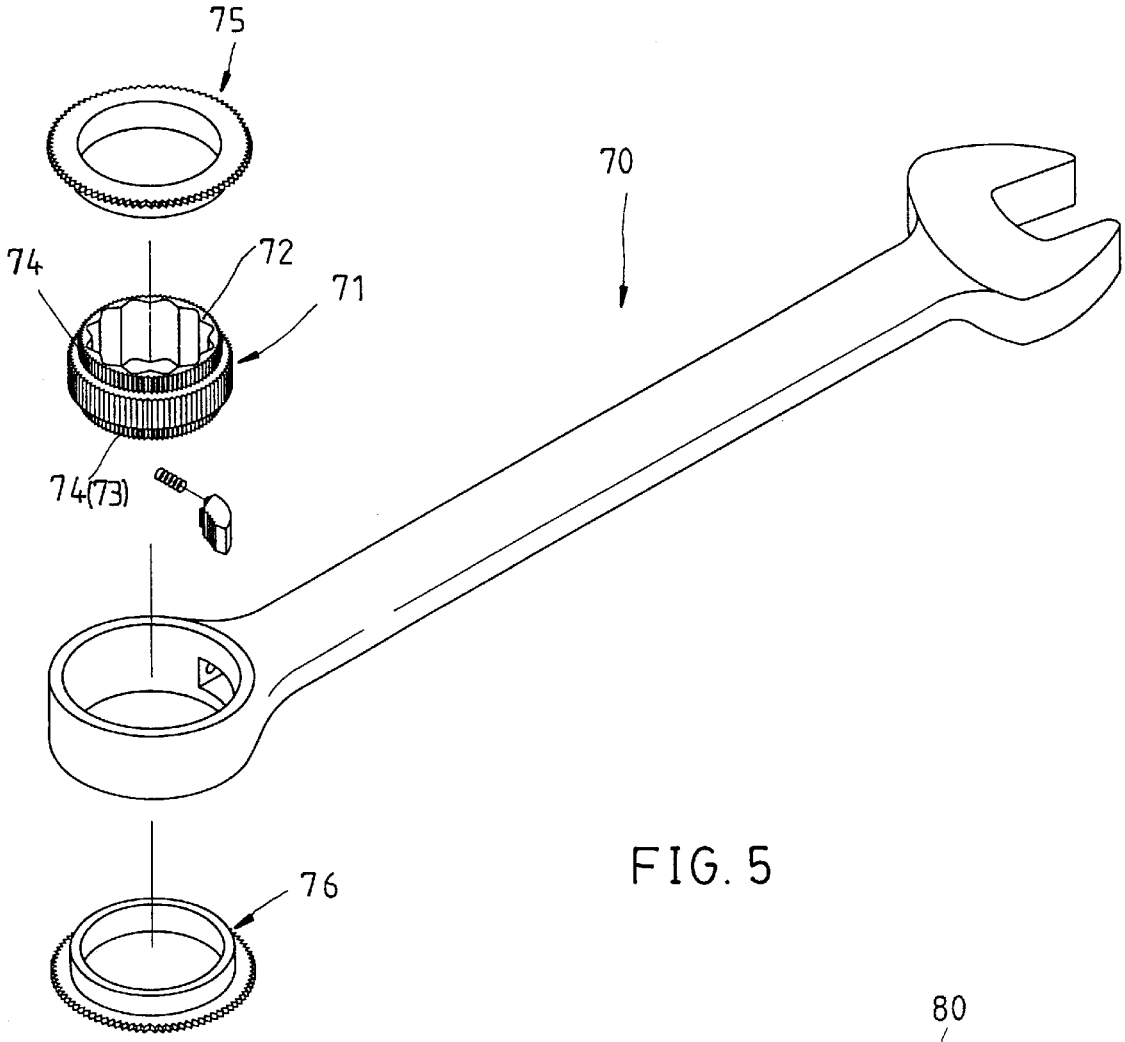
FIG. 5 is an exploded view of a second prefer embodiment of the present invention.

Please refer to FIG. 5, the second prefer embodiment of the present invention provides a ratchet wrench 70, which is similar to the first prefer embodiment as described above, except that the driving member 71 provides embossments 74 at the surfaces of the engaging portions 72 to make the driving member 71 holding the covering members 75 and 76 fixedly.

Figure 6:
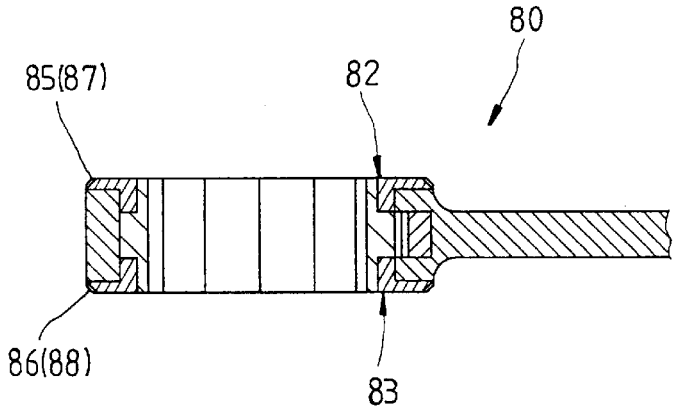
FIG. 6 is a sectional view of a third prefer embodiment of the present invention.

FIG. 6 shows a ratchet wench 80 of the third prefer embodiment of the present invention, which is similar to the first prefer embodiment, except that each covering member 81 or 82 respectively provide a 45 degrees inclination 85 or 86 at the edge of the flange 83 or 84. Each inclination 85 or 86 provides knurls 87 or 88 thereon for facilitating user to turn the covering members 81 and 82.

What is claimed is:

1. A ratchet wrench, comprising:

a wrench handle having a receiving portion at an end thereof, in which provides a chamber at a side thereof and a slot in said chamber;

a pawl installed in said chamber of said wrench handle having a teeth portion at a side thereof;

a spring installed in said chamber of said wrench handle having an end thereof rested against said pawl and the other end thereof rested in said slot in said chamber;

a driving member rotatably received in said receiving portion of said wrench handle and having an annular teeth portion at the outer surface thereof to mesh with said teeth portion of said pawl and two engaging portions at opposite sides of said teeth portion respectively, and two covering members, each of which has a tube, an opening at central of said tube and an annular flange at an end of said tube, each said flange having a diameter larger than the diameter of the receiving portion of the wrench handle;

said tubes of the covering members being respectively inserted into the spaces formed respectively between said receiving portion of said wrench handle and said engaging portions of said driving member with the openings of the tubes of the covering members firmly sleeved onto said engaging portions of the driving member respectively.

2. The ratchet wench as defined in claim 1, wherein each of said engaging portions of said driving member respectively has embossments at the outer surface thereof.

3. The ratchet wench as defined in claim 1, wherein said flange of said covering member has knurls at the periphery thereof.

4. The ratchet wench as defined in claim 1, wherein said wrench handle has an open-end wrenching portion opposite the receiving portion.

5. The ratchet wench as defined in claim 1, wherein said flange of said covering member has an inclination at the edge thereof.

6. The ratchet wench as defined in claim 5, wherein said inclination is about 45 degrees relative to said flange.

7. The ratchet wrench as defined in claim 1, wherein the diameter of the opening of the tube of the covering member is substantially equal to or slightly smaller than the outer diameter of the engaging portion of the driving member such that the opening is sleeved onto the engaging portion in an interference fit manner.

* * * * *